United States Patent [19]

De Marchi et al.

[11] Patent Number: 4,677,770

[45] Date of Patent: Jul. 7, 1987

[54] ALPINE SKI BOOT

[75] Inventors: Jean-Louis De Marchi, Duingt; Michel Mabboux, Seynod; Jean Paris, Sevrier; Norbert Kopp, Chavanod, all of France

[73] Assignee: Salomon S.A., Annecy, France

[21] Appl. No.: 811,451

[22] Filed: Dec. 20, 1985

[30] Foreign Application Priority Data

Dec. 20, 1984 [FR] France ..... 84 20161

[51] Int. Cl.[4] ..... A43B 5/04

[52] U.S. Cl. ..... 36/120; 36/117

[58] Field of Search ..... 36/117–121

[56] References Cited

U.S. PATENT DOCUMENTS

| | | | |
|---|---|---|---|
| 3,698,106 | 10/1972 | Rieker | 36/121 |
| 4,095,356 | 6/1978 | Robran et al. . | |
| 4,186,501 | 2/1980 | Salomon . | |
| 4,222,184 | 9/1980 | Kastinger . | |
| 4,454,663 | 6/1984 | Graillat . | |
| 4,455,768 | 6/1984 | Salomon | 36/121 |
| 4,551,933 | 11/1985 | Morell et al. | 36/120 |
| 4,577,420 | 3/1986 | Petrini et al. . | |

FOREIGN PATENT DOCUMENTS

| | | | |
|---|---|---|---|
| 0053340 | 6/1982 | European Pat. Off. . | |
| 3219772 | 1/1983 | Fed. Rep. of Germany | 36/120 |
| 2416660 | 9/1979 | France . | |
| 2433311 | 3/1980 | France | 36/121 |
| 57-86301 | 5/1982 | Japan . | |

*Primary Examiner*—James Kee Chi

*Attorney, Agent, or Firm*—Sandler & Greenblum

[57] ABSTRACT

A ski boot of the rear entry type having an upper and a shell base. The upper includes a front portion journalled on the shell base around a first journal and a rear portion journalled on the front portion around a second journal. The front portion of the upper includes two lateral extensions extending from the first journal to the heel of the shell base. A portion of the lateral extensions and/or the second journal engages an abutment on the shell base so as to rigidly link the upper to the shell base when the lower leg of the skier presses rearwardly on the the upper, thereby permitting the shell base to absorb this rearwardly directed force.

47 Claims, 17 Drawing Figures

ALPINE SKI BOOT

BACKGROUND OF THE INVENTION

1. Field of the Invention

The present invention relates to "rear entry" alpine ski boots comprising an upper having front and rear portions which surround the lower leg of the skier. More particularly, the invention relates to "rear entry" alpine ski boots comprising means for permitting the entry ahd removal of the foot to and from the boot, as well as for controlling the support for the lower leg of the skier during skiing.

2. Background Information

Rear entry type alpine ski boots generally comprise a shell base and an upper having front and rear portions. The rear portion is displaceable relative to the shell base and/or with respect to the front portion between a maintenance position in which the rear portion is positioned against the lower leg of the skier, and an open position which allows for disengagement of the foot of the skier from the boot or the introduction of the foot of the skier into the boot.

Thus, for example, U.S. Pat. No. 4,095,356 describes a ski boot which comprises an upper comprising latches for closing the upper on the lower leg of the skier. The upper further comprises a front portion, journalled around a journal element on the shell base. The front portion is provided with lateral extensions which extend on each side of the shell base. These extensions each comprise another journal axis on which the rear portion of the upper is journalled. In this type of boot, the control of the frontward and rearward pressure of the lower leg of the skier on the upper is achieved by means of a single front portion of the upper, associated with shock absorption elements. Because this control occurs essentially at the front portion of the upper, all of the rearward pressure exerted by the lower leg of the skier on the upper is supported by the closure latches of the upper.

Other rear-entry type boots, of the type described in U.S. Pat. No. 4,222,184, comprise a rear portion of the upper which pivots with respect to the shell base at the level of the heel of the boot around a first journal axis. This first journal axis is independent of the front portion of the upper. The front portion of the upper is also journalled around the shell base, but around another journal axis. In this type of boot, the control of the support forces is achieved again at the level of the front portion of the upper, which is provided with an extension extending to the front of the leg of the skier, and which is also provided with a collar adapted to maintain the extension against the leg. In this case, the rear portion of the upper serves only as a manipulation lever for holding down the foot inside the boot. This boot does not permit resistance to rearward pressure of the lower leg of the skier by means of the rear portion of the upper.

SUMMARY OF THE INVENTION

It is an object of the present invention to provide a ski boot which under all conditions properly supports the lower leg of the skier.

The present invention achieves this objective by providing a ski boot comprising a shell base and an upper. The shell base comprises an abutment, and the upper is mounted on the shell base. A part of the upper engages the abutment at least in response to rearward from the lower leg of the skier on the upper.

The upper further comprises a front portion and a rear portion, and the shell base further comprises a heel portion and two lateral sides. The front portion of the upper comprises two lateral extensions, each extending rearwardly along a different lateral side of the shell base to the heel portion of the shell base. In addition, the upper further comprises and element attached to the extensions. At least one member of the following group engages the abutment at least in response to rearward pressure from the lower leg of the skier on the upper; the extensions and the element.

In one embodiment the element comprises a first journal around which the rear portion of the upper pivots on the front portion of the upper. In this embodiment the first journal connects the extensions to each other so that the first journal comprises means for linking the extensions. In addition, the first journal extends generally tangentially to the heel portion of the shell base and generally transversely to the longitudinal axis of the boot. The extensions each comprise a rear end portion, integrally connected to each other. In one alternative embodiment the first journal comprises the integral connection between the rear end portions of the extensions. In another alternative embodiment the front portion of the upper comprises a transversely extending linkage element integrally linking the two rear end portions of the two extensions.

In each of these embodiments described above the boot can further comprise means for closing the rear portion of the upper on the front portion of the upper. This closing means connects the front and rear portions of the upper.

The boot further comprises a second journal on which the upper is at least partially journalled on the shell base. In this embodiment the extensions extend from the second journal to the heel portion of the sheel base.

The front portion of the upper can be adapted for forward flexion around the second journal. In this embodiment the boot further comprises means for controlling this forward flexion of the front portion of the upper.

The extensions can comprise a lateral portion extending from the second journal to the heel portion of the shell base. Also, the front portion of the boot is adapted to flex forwardly to a forward position from a rest position and to flex rearwardly from the forward position to the rest position. In this embodiment the boot further comprises means for engaging the abutment with the lateral portions of the extensions in response to flexion of the front portion of the upper.

The shell base can comprises two lateral sides. In this embodiment the abutment extends along at least a portion of the two lateral sides from the second journal to the heel portion of the shell base and around the heel portion of the shell base. In this embodiment the abutment is adapted to engage the extensions from the second journal to the heel portion of the shell base.

In another embodiment one of the members of the following group comprises at least one lip: the front portion of the upper, and the rear portion of the upper. In this embodiment the abutment extends around the heel portion of the shell base and the abutment at the heel portion of the shell base comprises at least one groove for engaging the lip.

In another embodiment the abutment is positioned at the heel portion of the shell base directly beneath the first journal. In addition, the abutment can extend transversely to the longitudinal axis of the shell base and generally tangentially to the heel portion of the shell base. Also, the abutment can extend from the heel portion of the shell base at least partially toward the first journal.

In still another embodiment the heel portion of the shell base comprises a wall, and the abutment comprises a shoulder having a thickness greater than the wall of the heel portion of the shell base. The abutment can form an integral portion of the shell base, or the boot can comprise an assembly connecting the abutment to the shell base so that the abutment is integral with the shell base via the assembly.

In another embodiment the abutment extends only between the rear end portions of the extensions.

In still another embodiment the front portion of the upper comprises a bridge connecting the rear end portions of the extensions. In this embodiment the abutment is positioned directly under the bridge and extends to the second journal, the bridge is adapted to engage the abutment directly under the bridge, and the first journal extends between the rear end portions of the extensions above the bridge. In addition, in this embodiment the boot has at least one opening therein, and further comprises means for holding the skier's foot down in the boot. This holding means comprises a lever journalled on the rear portion of the upper, and a cable attached to the lever and extending through the opening to extend inside the boot over the foot. The lever comprises means for tightening and loosening the cable, thereby adjusting the force with which the foot is held down in the boot.

In still another embodiment the rear portion of the upper comprises a journal housing having an opening therein and adapted to receive the first journal therethrough. The rear end portions of the extensions each comprise an opening therein adapted to receive the first journal therethrough, and the journal housing is adapted to be positioned between the rear end portions of the extensions so that the opening in the journal housing is aligned with the openings in the rear end portions of the extension. The openings in the rear portions of the extensions are positioned directly above the heel portion of the shell base, and the abutment is positioned directly under the journal housing. In addition, the shell base has an opening therein for receiving the journal housing therein during rearward flexion of the rear portion of the upper. Also, the shell base further comprises a lip on the heel portion of the shell base and adjacent the journal housing. This lip extends substantially concentrically to the first journal.

In still another embodiment the rear portion of the upper comprises two spaced apart bosses each attached to one of the rear end portions of the extensions. The first journal is supported by and extends between the two spaced bosses. Thee abutment extends between the two spaced apart bosses, and the first journal is supported by the abutment so as to cooperate with the abutment to control pressure of the lower leg of the skier on the rear portion of the upper. In addition, the first journal engages the abutment in response to a rearwardly directed flexion force generated by the lower leg of the skier on the rear portion of the upper. In one an alternative embodiment the boot further comprises at least one adjustable, elastic deformable element positioned between the abutment and the first journal. This element can be a compression spring or an extension spring. If it is an extension spring, this extension spring can comprise a first end and a second end, and the boot can further comprise a third journal attached to the shell base and connecting the first end of the extension spring to the shell base. The second end of the extension spring is attached to the first journal.

In still another embodiment the first journal integrally connects the rear end portions of the extensions, and the boot further comprises means for controlling the support of the front and rear portions of the lower leg of the skier by the upper. In this embodiment the upper is at least partially journalled on the shell base against the bias of the control means, and the abutment comprises upper and lower abutments. The lower abutment supports the first journal, the upper abutment is positioned above the first journal, and the first journal engages the upper abutment in response to frontward pressure of the lower leg of the skier on the front portion of the upper. Also, the first journal engages the lower abutment in response to rearward pressure of the lower leg of the skier on the rear portion of the upper, so that the control means comprises the upper and lower abutments and the first journal.

The rear portion of the upper can further comprise two spaced apart bosses, each attached to one rear end portion of one of the extensions. The first journal is supported by bosses and the upper and lower abutments are positioned between the bosses. In an alternative embodiment a compression spring is positioned between the upper abutment and the first journal.

In another embodiment the shell base can comprises a rear end heel zone and the upper and lower abutments extend substantially transversely to the longitudinal axis of the shell base and extend approximately tangentially to the rear end heel zone. The upper and lower abutments are vertically spaced from one another a distance sufficient for passage of the first journal therebetween. In this embodiment the shell base comprises a wall comprising the rear end heel zone. The upper and lower abutments each comprise a shoulder having a thickness greater than the thickness of this wall. In one embodiment the upper and lower abutments are integral with the shell base. Alternatively, the boot can further comprise an assembly connecting the upper and lower abutments to the shell base so that the upper and lower abutments are integrally connected to the shell base by the assembly.

In still another embodiment, the boot further comprises a sole, and the longitudinal axis of the extensions extends rearwardly between a plane parallel to and passing through the sole and a line extending through the second journal at an approximately 45 degree angle to a horizontal plane.

In still another embodiment means are provided for adjusting the vertical position of the abutment along the heel portion of the shell base.

In another embodiment a removable wedge is provided. The wedge is removably attached to the boot between the rear end portion of the extensions and the abutment so as to define a predetermined advancement position of the upper with respect to the shell base. The invention can also comprises this boot in combination with a plurality of wedges each of a different thickness. Each of the plurality of wedges are adapted to be removably attached to the binding between the abutment and the rear end portion of the extensions.

In another embodiment one of the members of the following group has an oblong slot therein, and the other member of the following group is attached to the first journal: the front portion of the upper and the rear portion of the upper. In this embodiment the boot further comprises a floating hinge around which the rear portion of the upper is journalled on the extensions. The floating hinge comprises the first journal engaging the oblong slot. In addition, one of the members of the following group comprises a journal element having the oblong slot therein: the front portion of the upper and the rear portion of the upper. In this embodiment the abutment comprises a horizontal and a vertical surface. The journal element engages the horizontal surface in response to downward vertical forces acting on the upper, and the journal element engages the vertical surface in response to rearward pressure from the lower leg of the skier on the rear portion or part of the upper. The vertical surface comprises means for preventing the rear portion of the upper from rearward pivoting to an open position in which the foot of the skier can be placed in or removed from the boot until the journal element is raised above the vertical surface. In addition, the boot can further comprise means for pivoting the rear portion of the upper with the front portion of the upper during forward flexion of the front portion of the upper.

BRIEF DESCRIPTION OF THE DRAWINGS

The invention will now be described with reference to the attached drawings given by way of non-limiting example only, in which:

FIG. 1 illustrates a perspective view of the first embodiment;

FIG. 2 illustrates a partial cross-sectional view taken along line II—II in FIG. 1;

FIG. 3 illustrates is a cross-sectional view taken along line III—III in FIG. 1 in which a detailed view of the assembly of the front portion of the upper in its support zone on the shell base is shown;

FIGS. 4 and 5 illustrate a second embodiment of the ski boot of the present invention in which FIG. 4 illustrates a perspective view of the boot of the second embodiment of the present invention, and FIG. 5 illustrates a partial cross-sectional view of the second embodiment of the ski boot of the present invention taken along line IV—IV in FIG. 4;

FIG. 6 illustrates a perspective, partially exploded view of the upper illustrating the details of the assembly of the rear portion of the upper with the front portion of the upper, wherein the support of the upper with the shell base is achieved by means of a journal housing on the rear portion of the upper;

FIG. 7 illustrates a partial cross-sectional view taken along line VII—VII in FIG. 6;

DETAILED DESCRIPTION OF PREFERRED EMBODIMENTS

Figure 1:
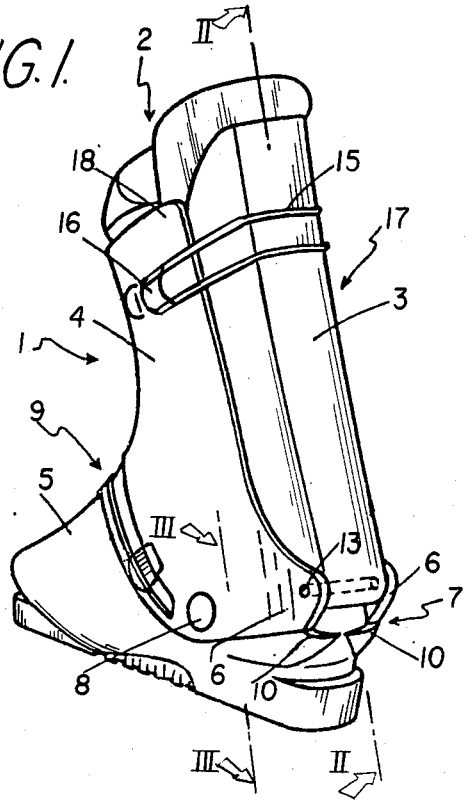
FIGS. 1, 2 and 3 illustrate a first embodiment of the ski boot of the present invention.

It is an object of the present invention to provide a ski boot of the rear entry type having a rear upper portion, journalled with respect to a front upper portion, which assures under all conditions the proper support of the lower leg of the skier, and which abosrbs rearward pressure of the lower leg of the skier on the upper by an abutment provided on the shell base. The abutment is positioned substantially in a zone in which the rear portion of the upper is journalled on the front portion of the upper. This zone, in turn, is located in a zone around and including the heel of the boot. Furthermore, it is also an object of the invention to use the rear portion of the upper of a rear entry ski boot to provide rear support for the lower leg of the skier; support for forward flexion of the lower leg also being provided by the front portion of the upper, as well as, when necessary, by the rear portion of the upper.

A first embodiment of the present invention which achieves these objectives comprises a boot comprising an upper and a shell base. The upper comprises a front portion and a rear portion. The front portion of the upper is connected to the shell base by a transverse journal substantially at the level of the malleoli of the foot of the skier. The front portion of the upper extends from the top of the instep zone of the foot to a zone at the rear of the heel of the shell base by at least partially surrounding each of the sides of the boot. To accomplish this, the front portion comprises two lateral extensions. These lateral extensions begin at a zone at a lower portion of the front portion of the upper at the level of the journal. These lateral extensions then extend toward a zone around and including the heel of the shell base. Another transverse journal is provided on these extensions which links the front portion of the upper with the rear portion of the upper. Furthermore, a shoulder provided on the lateral walls of the rear of the shell base cooperates partially with each of the extensions of the front portion of the upper.

By virtue of this structure the extensions of the front portion of the upper abut against the shoulder to assure the control of the rearward pressure of the lower leg of the skier on the rear part of the upper. It should be noted that the rear part of the upper can refer to the rear portion of the upper which is journalled on the front portion of the upper, and the rear part of the upper can also refer to the extensions of the front portion of the upper.

In addition, closing means are also provided for closing the upper on the lower leg of the skier. These closing means are associated with the upper, and can comprise, for example, latches or cable stretchers, for example, to assure the closing of the upper on the lower leg of the skier.

A second embodiment of the ski boot of the present invention is similar to the first embodiment, but differs in that the position of the shoulder or an equivalent structure is limited to the rear zone of the heel of the shell base. In this embodiment the shoulder cooperates only with the rear portion of the upper substantially at the level at the journal on which the rear portion of the upper is mounted on the front portion of the upper.

In a third embodiment of the invention, the extensions of the front portion of the upper join one another at the height of the heel of the shell base and form a sort of stirrup which surrounds the rear of the shell base. In this embodiment, the shoulder provided on the shell base in a zone corresponding to the stirrup serves as an abutment for the stirrup when the skier presses his lower leg rearwardly on the rear portion of the upper.

In a fourth embodiment of the boot according the present invention, the rear portion of the upper is journalled by two bosses positioned between the rear ends of the extension of the front portion of the upper. These bosses are adjacent to the ends of the extensions. A journal extends between the two bosses and the ends of the extensions, and is supported by the two bosses. As a result, the bosses, the journal, and the end of the two extensions together comprises a hinge-type linkage means linking the front and rear portions of the upper. In this embodiment the journal comprises a cut out portion positioned between each of the bosses which abuts against a first shoulder of the shell base when the skier presses his lower leg rearwardly against the rear portion of the upper. The shell base also comprises is a second shoulder, spaced from the first shoulder by a distance greater than the cross-section of the cut out portion of the journal. This second shoulder is positioned above the first shoulder in the zone of the heel of the shell base, and defines an upper abutment against which the journal axis is supported when the upper is subjected to front flexional forces of the lower leg of the skier on the front portion of the upper. As a result, it is possible to control and adjust the front flexion movements of the boot by subjecting the journal axis to the bias of an elastic apparatus contacting the journal axis and the shell base. In this alternative embodiment using an elastic apparatus, several variations are possible, depending upon whether the elastic apparatus comprises a deformable element which produces a force when compressed or a deformable element which produces a force when extended. In all of these alternative embodiments the rear portion of the upper remains journalled with respect to the front portion, even when there is extreme flexion of the upper.

Figure 2:
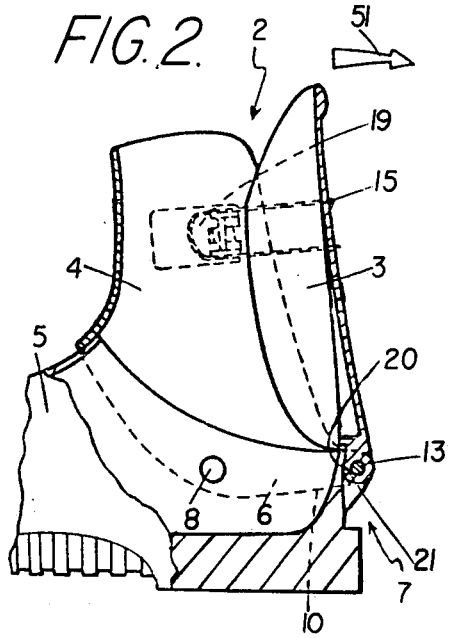

In a known manner, according to the embodiment illustrated in FIGS. 1 and 2, a ski boot 1 comprises a rigid shell base 5 on which an upper 2 is mounted. Upper 2 comprises two portions, a front portion 4 and a rear portion 3. Rear portion 3 is displaceable with respect to front portion 4 so as to allow for the introduction of the foot of the skier into the boot, and so as to permit the foot of the skier to be removed from the boot. Also provided is a closure system for upper 2. The closure system comprises a cable 15 subject to the action of a stretcher 19, illustrated in FIG. 2. Stretcher 19 is integral with one of the lateral sides 17 of front portion 4. A notched portion 16, illustrated in FIG. 1, is provided on the other lateral side 18 of front portion 4 to attach cable 15 to one side of portion 4, thereby assuring the reciprocal closing of portions 3 and 4 of the upper and their maintenance against the leg of the skier, when stretcher 19 stretches or tensions cable 15.

So as to permit forward flexional movement of the leg of the skier and a corresponding rearward, return flexion of the leg of the skier during skiing, front portion 4 is pivotably mounted on shell base 5 by means of a transverse journal 8, as illustrated in FIG. 1. It is within the scope of the present invention to provide the ski boot illustrated in FIG. 1 and in the other Figures with forward flexion control and adjustment means 9 as known in the art. These forward flexion controls 9 can be positioned on front portion 4 of the boot.

Figure 3:
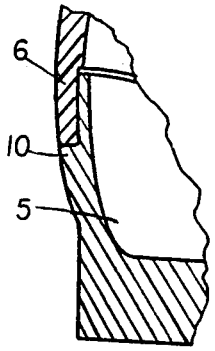

Rearward flexion or rearward pressure of the lower leg of the skier on the upper can also be controlled by the boot of the present invention. In order to control this rearward pressure, shell base 5 is provided with abutment means for abuting a portion of the upper in response to rearward pressure of the lower leg of the skier on the upper of the boot. In the embodiment illustrated in FIGS. 1–3, this abutment means comprises shoulders 10 provided on each lateral side of shell base 5. Shoulders 10 extend from each lateral side of shell base 5 to the heel portion 7 of shell base 5 and along the full extent of heel portion 7. The portion of the upper that engages shoulders 10 in the embodiment seen in FIGS. 1–3 are extensions 6 of front portion 4. Extensions 6 abut shulders 10 in response to a rearward return flexion of front portion 4 which occurs after front portion 4 has flexed forwardly in front of the rest position illustrated in FIGS. 1 and 2. This return flexion returns front portion 4 to its rest position illustrated in FIGS. 1 and 2. As a result, shoulders 10 and extensions 6 comprise means for controlling the rearward support upper 2 provides to the lower leg of the skier.

Rear portion 3 is journalled on front portion 4 around a transverse journal 13. Journal 13 integrally connects the two extensions 6 of the front portion 4 in the zone of heel 7. These extensions 6 also engage shoulders 10 which comprise the means for controlling the rear support provided by upper 2. As a result, rear portion 3 cooperates with control means 10. As illustrated in FIG. 3, shoulders 10 comprise a horizontal wall for supporting the bottom end of extensions 6, and a vertical wall for supporting on vertical wall of extensions 6. Consequently, control of the support provided by the upper for the rear of the lower leg of the skier is achieved by absorbing the forces generated by the rearward pressure of the lower leg of the skier on the upper by shell base 5, preferably in the zone extending from transverse journal 8 of front portion 4 to heel 7. Furthermore, in this rear zone of heel 7, the sealing of portions 3 and 4 of upper 2 on shell base 5 can be achieved by means of lips 20 and corresponding grooves or seats 21. In one embodiment lips 20 can be provided on upper 2, which are adapted to sealingly engage grooves or seats 21 on shell base 5. Alternatively, lips 20 can be provided on shell base 5 and grooves or seats 21 can be provided on upper 2, depending upon the contemplated construction of the boot.

Figure 4:
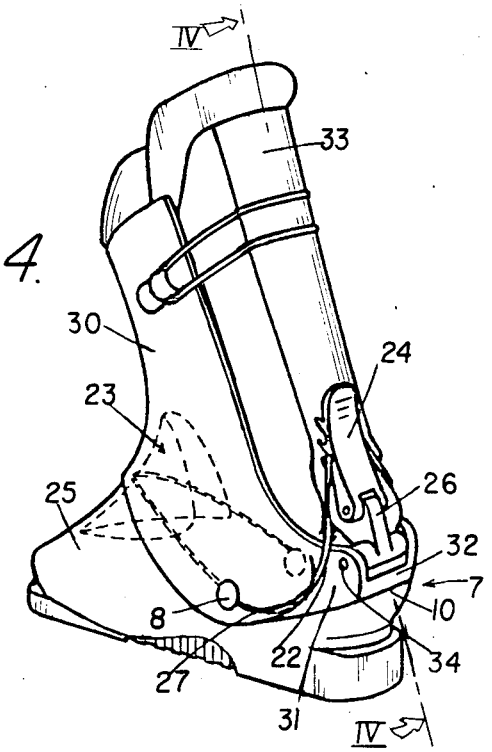
Figure 5:
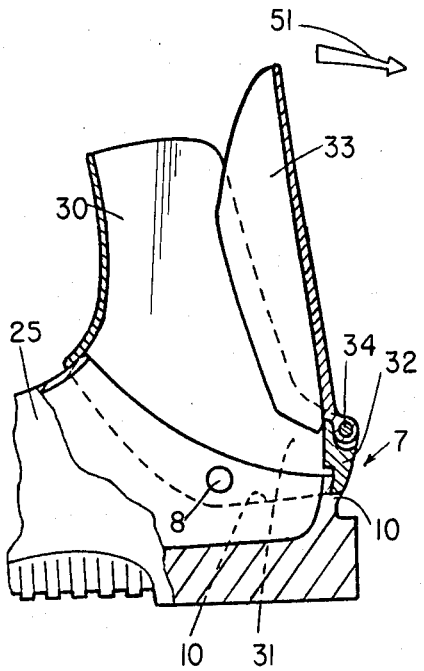

In a second embodiment of the invention illustrated in FIGS. 4 and 5, front portion 30 comprises extensions 31 which extend to heel 7 and are connected to one another by means of a "bridge" 32 surrounding the rear of shell base 26. In this embodiment rear portion 33 of the upper is pivotably mounted around a transverse journal 34 on extensions 31 of front portion 30 above "bridge" 32. "Bridge" 32 is adapted to engage a shoulder 10 extending around the periphery of the rear of heel 7 of shell base 25 under "bridge" 32. Thus, control of the support provided by the upper for the rear of the lower leg of the skier is achieved exactly from the entire zone of heel 7 to journal axis 8 of front portion 30. In this embodiment, a device 32 for holding down the foot inside the boot, known in the art, can preferably be associated with rear portion 33. This hold down device comprises a stretching or tensioning lever 24 for stretching or tensioning and loosening a cable 22. Lever 24 can be, for example, pivoted on a boss 26 on rear portion 33. In addition device 32 can further comprises portions 27 for guiding cable 22. Guide portions 27 can be positioned at approximately the height of heel 7 on front portion 30.

In these first two embodiments the control of the support provided by the upper to the rear portion of the lower leg of the skier is obtained directly by interaction of the support surfaces of extensions 31 of the front portion of the upper on shoulder 10 of the shell base. However, this control of the support provided by the upper for the rear portion of the lower leg of the skier, and the control of the pressure of the rear portion of the lower leg of the skier on the upper can be re-transmitted to the front portion of the upper by means of the rear portion of the upper which is supported against abutment 43 of the shell base. Such an embodiment is illustrated in FIGS. 6 and 7.

Figure 7:
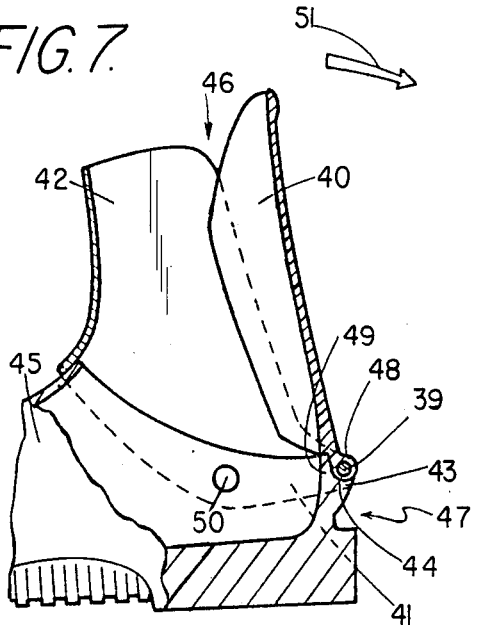
FIGS. 6 and 7 illustrate schematic views of a third embodiment of the ski boot of the present invention.
Figure 6:
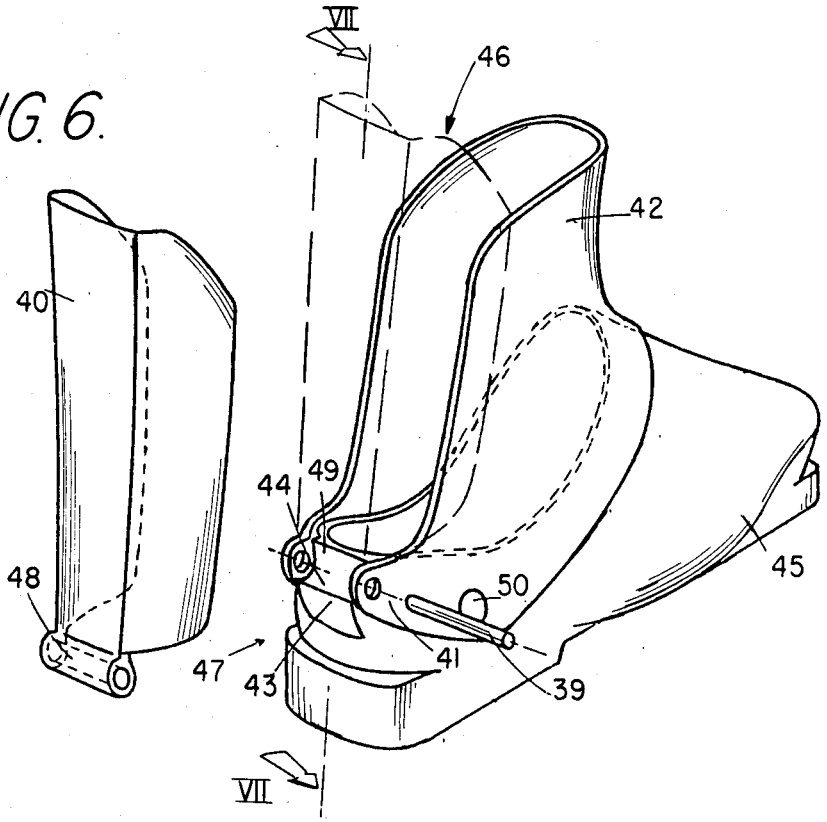

FIGS. 6 and 7 illustrate a rear portion 40 of the upper which is journalled on extensions 41 of front portion 42 around a journal 39 positioned at the level of heel 47 of shell base 45. In order for this journalling of rear portion 40 on front portion 42 to take place several additional elements may be provided. The rear end portions of extensions 41 can each have an opening therein of sufficient size to receive journal 39. In addition, the bottom end of rear portion 40 comprises a journal housing 48 having an opening therein which is also of sufficient size to receive journal 39 therethrough. Also heel portion 47 of shell base 45 has a recess or opening 44 therein which is defined between adjustment lip 49 and abutment shoulder 43 and which can accommodate journal housing 48 therein so that journal 39 can extend through each of the openings in extensions 41 and the opening in journal housing 48 when the openings in the extensions are aligned with the opening in journal housing 48. As a result, journal 39 is positioned in opening 44 and through means of journal housing 48 rear portion 40 is positioned in opening 44 and abuts against abutment shoulder 43 in the event of rearward flexion of rear portion 40 which is caused by rearward pressure of the lower leg of the skier on upper 46. In addition, shell base 45 further comprises an adjustment lip 49 having a profile which is substantially concentric to journal axis 50 around which front portion 42 is journalled on shell base 45.

As a result of the structure illustrated in the embodiments of FIGS. 1–7, the journals of rear portions 3, 33, 40 which permit these elements to pivot on extensions 6, 31, 41, respectively, permits the rear portion of the upper in these embodiments to pivot along the direction of arrow 51 illustrated in FIGS. 2, 5 and 7, thus pivoting the rear portion into an open position in which the rear portion is totally disengaging from the front portion of the upper except at the journal, thereby as to allow for insertion and removal of the foot from the boot.

Figure 8:
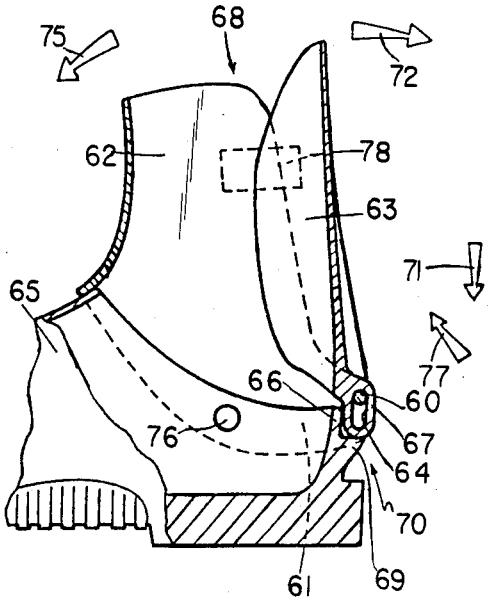
FIGS. 8, 9 and 10 illustrate partial cross-sectional, elevational views of another embodiment of the ski boot of the present invention illustrating the journalling of the rear portion of the upper on the extensions of the front portion of the upper.
Figure 9:
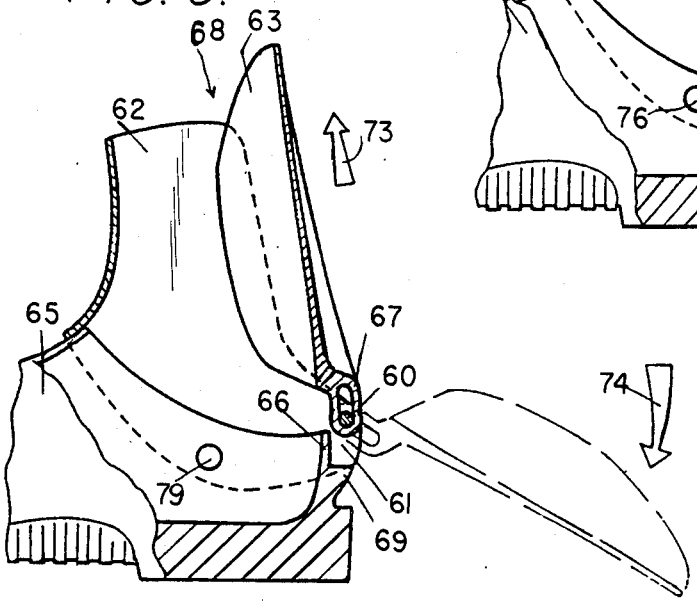

This same result can be achieved, as shown in FIGS. 8 and 9, by means of a "floating" hinge whose journal 60 has two functions: to integrally link the two lateral extensions 61 of front portions 62, and to serve as a pivotal connection between rear portion 63 and front portion 62, thereby permitting rear portion 63 to pivot on front portion 62. Rear portion 63 is freely mounted around journal 60 by means of an oblong slot 64 provided in journal element 67 on rear portion 63. Journal 60 passes through slot 64. The adjustment or control of forces generated by the pressure of the leg on the upper and the adjustment of rear portion 63 on shell base 65 and the level of the hinge can be accomplished by an edge 66 integral with shell base 65, and against which journal element 67 is adapted to be supported when upper 68 is positioned in its closed position illustrated in FIG. 8.

In this embodiment the absorption of the forces generated by the leg of the skier pressing on the upper by shell base 65 is directly assured by projection 69 on heel 70, and edge 66. Journal element 67 abuts projection 69 in response to pressure from the leg of the skier in the downward direction indicated by arrow 71, thereby communicating this downward force to shell base 65. In addition, journal element 76 abuts edge 66 in response to rearward pressure from the lower leg of the skier on rear portion 63 along the direction of arrow 72 in FIG. 8.

The opening of the upper, as illustrated in FIG. 9, occurs by successive displacement or rear portion 63 along two different directions, i.e. a first direction 73, which is in a longitudinal direction from the bottom to the top of the boot, which serves to liberate journal element 67 from edge 66 of shell base 65, and a second direction 74, which is a circular direction serving to disengage or open the rear of the upper.

In order to guarantee that rear portion 63 is displaced with and follows front portion 62 during frontward flexion of front portion 62 along the direction of arrow 75, journal 60 is positioned on extensions 61 in combination with the oblong slot 64 such that journal 60 is supported on the end of slot 64 when the upper is in its closed position illustrated in FIG. 8; thus, when front portion 62 pivots on its journal 76 in the direction 75 under the effect of a force in the same direction, journal 60 is simultaneously displaced along a trajectory 77 which is substantially concentric around journal 76, thus causing the displacement of rear portion 63 with front portion 62 in the same direction thereof.

Figure 10:
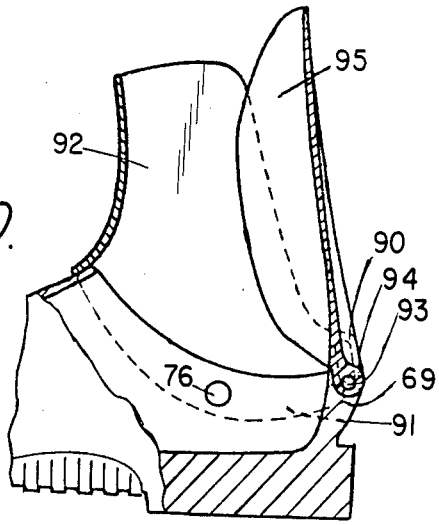

It is also within the scope of the invention to reverse the elements to which the journal and the journal element are attached in FIG. 9, as is illustated in FIG. 10. In this embodiment slot 90 is positioned not on the rear portion of the upper but on extensions 91 of front portion 92 of the upper, and journal 93 and journal element 94 are positioned on rear portion 95. All of the other elements remain in the same relationship as in FIGS. 8 and 9, and the method of opening the boot is identical to that illustrated in FIG. 9.

Figure 11:
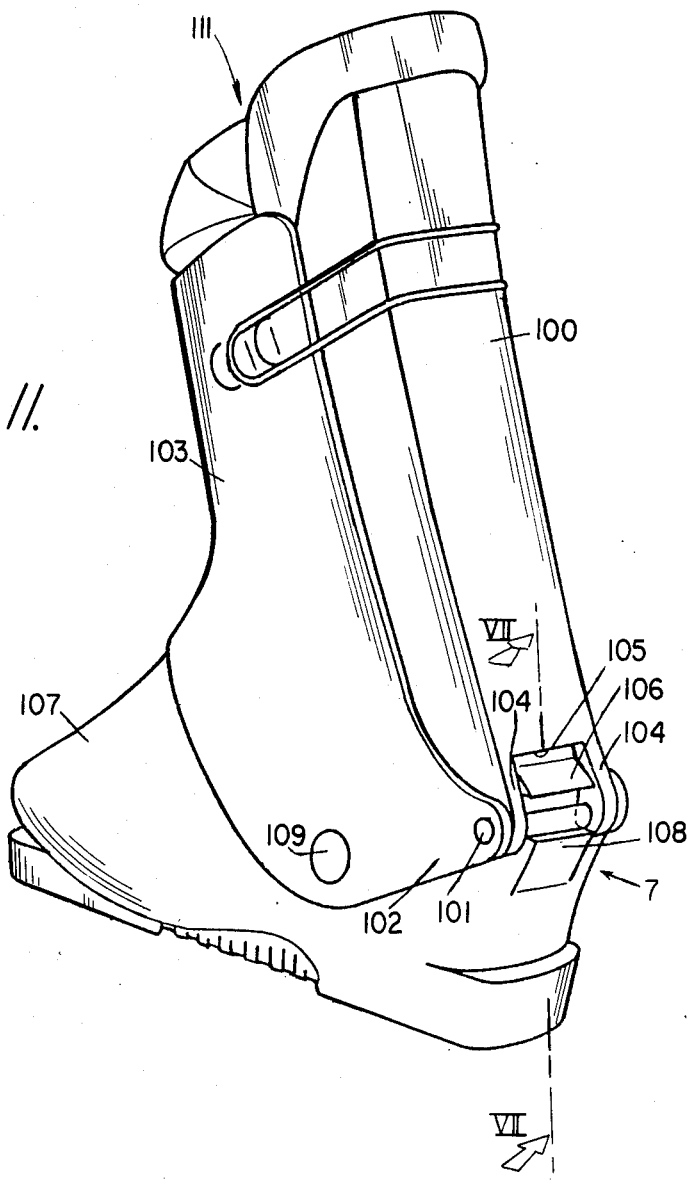
FIG. 11 illustrates a perspective view of a fourth embodiment of the boot of the present invention.

According to another embodiment of the boot illustrated in FIG. 11, rear portion 100 of upper 111 can be journalled on front portion 103 by means of journal 101. Journal 101 is attached at each of its ends to one of two spaced projections 104 at the bottom of rear portion 100. In addition, each projection 104 is attached to one of the rear end portions of extensions 102. Journal 101 is supported by and extends between projections 104 and each rear end portion of extensions 102. As a result, journal 101 connects the two extensions 102 to each other.

Rear portion 100 also has a cut out portion 105 therein to allow for the passage of two bosses 106 and 108 therethrough. Bosses 106 and 108 are integral with shell base 107 and comprise the abutment means of shell base 107. Bosses 106 and 108 are positioned at the rear end heel zone of shell base 107. This zone is positioned at the rear of the shell base and includes the heel of the shell base. This zone of the shell base comprises a wall of the shell base. In addition, the two bosses 106 and 108 each comprise a shoulder having a greater thickness than this wall. Boss 106 is positioned above boss 108, and both bosses 106 and 108 are positioned in the zone of heel 7 such that journal 101 is supported on lower boss portion 108 which serves as a means for controlling the support provided by the boot for the rear portion of the lower leg of the skier and for controlling rearward pressure of the lower leg of the skier on the upper. Upper boss 106 is positioned above lower boss 108 at a distance from lower boss 108 substantially equal to the distance journal 101 will traverse when rear portion 100 pivots to its full angular extent. Upper boss 106 controls the flexional movement of upper 111 in the frontward direction. As a result, rearward and forward pressure of the lower leg of the skier on upper 111 can be controlled.

This can be accomplished as follows. As in the preceding embodiments, front portion 103 is pivotably mounted on shell base 107 around a journal 109. When the skier presses his lower leg against front portion 103, thereby resulting in the forward displacement of front portion 103, the forces generated by the skier are simultaneously transmitted to the rear portion 100 by means of journal axis 101 to shell base 107 because journal 101 engages boss 106. Similarly, when the skier presses his lower leg rearwardly against rear portion 100, journal 101 engages lower boss 108, thereby transmitting the forces from the leg to shell base 107. Because upper boss 106 engages journal 101 during forward pressure of the lower leg on portion 103, boss 106 limits the angular extent to which front portion 103 can be pivoted. The extent to which the upper can pivot forwardly depends upon the distance between the fork formed by bosses 106 and 108.

Figure 12:
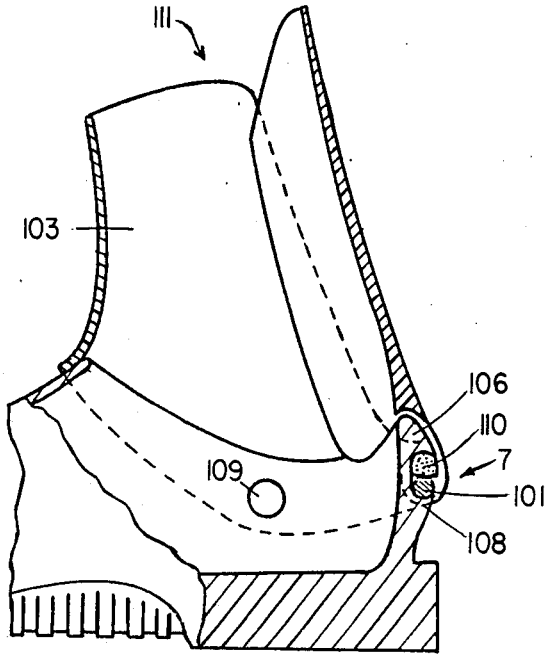
FIG. 12 illustrates a partial cross-sectional view taken along line XII—XII in FIG. 11, but which also provides an apparatus for controlling the front flexion of the front portion of the upper.
Figure 12A:
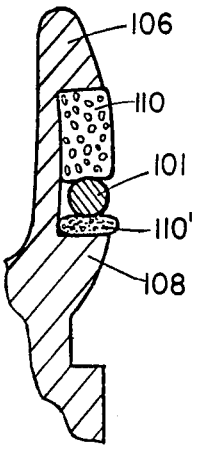
FIG. 12*a* illustrates an enlarged view of the front flexion control apparatus illustrated in FIG. 12.
Figure 13:
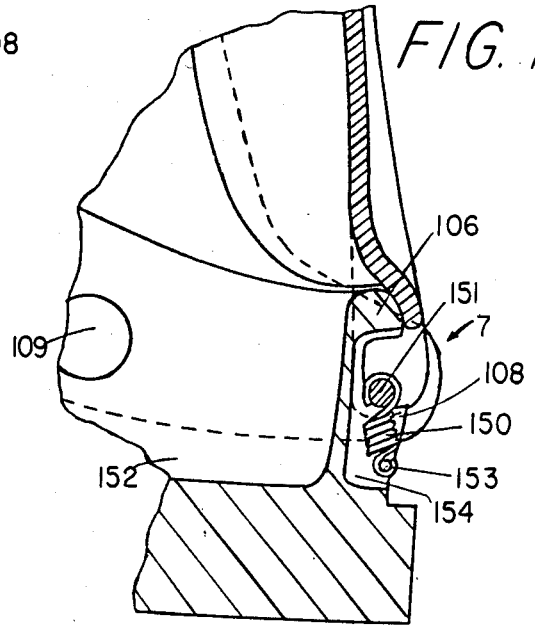
FIG. 13 illustrates a partial cross-sectional view another embodiment of the flexion control apparatus which is similar to that of FIG. 12, but which comprises an elastic deformation element which elastically deforms when extended.

It is within the scope of the invention to provide means for adjusting the flexional force with which one can flex the upper. This adjusting and controlling means is preferably positioned, as is illustrated in FIGS. 12 and 13, in the zone of the heel between bosses 106 and 108 of the embodiment previously described with respect to FIG. 11. In FIG. 12, this adjusting and controlling means comprises an element 110 which is elastically deformable when compressed. Element 110 is positioned between boss 106 and journal 101. This positioning of element 110 allows for the relative displacement between bosses 108 and 106 of journal 101, and thus places upper 111 under a permanent elastic tension to assure control of the flexional forces directed towards the front of the upper. It is also within the scope of the invention to provide a deformable elastic element 110 which is also positioned between journal 101 and abutment 108, as illustrated in FIG. 12*a* so as to offer the skier the possibility of a progressive pivoting in the rearward direction. Furthermore, these frontward and rearward control apparatus can comprise an elastic force adjustment means and they are adapted to transmit these forces to journal 101 and shell base 107.

FIG. 13, illustrates another embodiment of the boot of the present invention in which the control of the flexional forces produced by the lower leg of the skier in the forward direction on the upper is accomplished by means of a elastic deformation element which elastically deforms when extended, such as extension spring 150. Spring 150 is hooked at one end to journal 151 around which the rear portion of the upper pivots on the front portion of the upper. The other end of spring 150 is attached to shell base 152 by means of journal 153. An opening 154 is provided in shell base 152 of the passage of spring 150, and the other constituent elements of the boot are identical to those described in FIG. 12.

Figure 14:
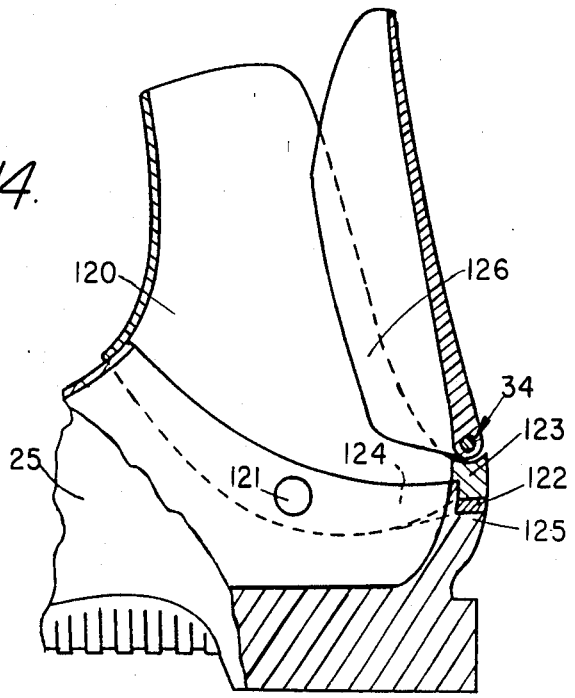
FIG. 14 illustrates a partial cross-sectional view of a boot of the type shown previously which also comprises means for adjusting the advancement angle of the upper.

FIG. 14 illustrates an embodiment in which the angular position of front portion 120 (and thus that of rear portion 126) in a longitudinal plane of the boot with respect to journal 121 of front portion 120 can be modified by means of adjustable wedges 122. Wedges 122 are adapted to be interposed between bridge 123 of front portion 120 (which links extensions 124 of front portion 120) and shoulder 125 (which comprises a support control abutment). In an embodiment that is not shown, the angular position of front portion 103 illustrated in FIG. 11 is determined by the interposition between journal 101 and boss 108 of interchangeable adjustment wedges 122 such as those which were described with reference to FIG. 14. In addition, in both of these embodiments, wedges of different thicknesses can be used so as to vary the angular position of the upper.

Figure 15:
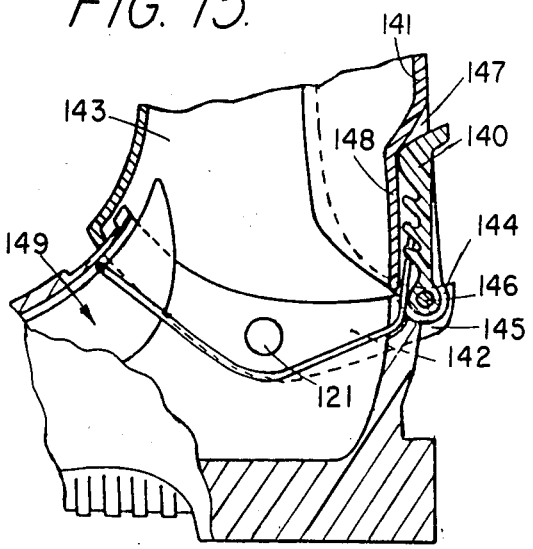
FIG. 15 illustrates a partial cross-sectional view of a portion of a boot similar to that shown in FIG. 4, but in which the journal for the rear lever is the same as the journal on which the rear portion of the upper is mounted on the front portion of the upper.

In those boots using a device 23 for holding down the foot inside the boot down associated with rear portion 33, it is preferable to combine the embodiments of FIGS. 4 and 11 so as to obtain the embodiment illustrated in FIG. 15. In this embodiment a stretching or tensioning lever 140 for tensioning a cable is associated with a rear portion 141 of the upper. Lever 140 is journalled on extension 142 of the front portion of 143 by means of a hinge type linkage similar to that described in FIG. 11. In this case, lever 140 is positioned between the two bosses 144 of the rear portion 141. Bosses 144 are positioned between the ends 145 of extensions 142 and lever 140 is journalled on journal 146. Rear portion 141 is also journalled on front portion 143 by journal 146. For reasons for sealing and/or attaching, a cut out portion 147 provided between the two bosses 144 of the rear portion 141 comprises an end 148 against which stretcher lever 140 is supported when lever 140 is pivoted into a position in which lever 140 tensions the cable and internal hold down apparatus 149. In this embodiment journal 146 abuts the central rear abutment of the shell base in response to rearward pressure of the lower leg of the rear portion of the upper.

Figure 16:
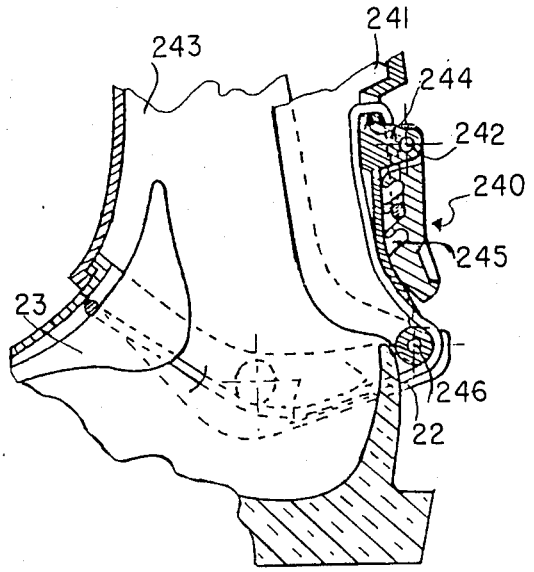
FIG. 16 illustrates a partial cross-sectional view of an alternative embodiment of the boot comprising a device for holding down the foot inside the boot that is similar to FIG. 15, but in which traction cable 22 is wound behind the journal of the rear portion of the upper.
Figure 16A:
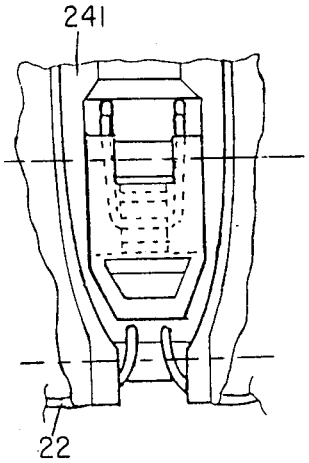
FIG. 16*a* illustrates a rear view of the boot illustrated in FIG. 16.

The embodiment illustrated in FIG. 16 and 16*a*, shows a control apparatus 23 for internally holding down the foot in the boot which is similar to that described in FIG. 15, but whose traction cable 22 is wound behind a journal 246, around which rear portion 241 pivots on front portion 243. Cable 22 is thus constrained and tensioned by a toggle or elbow-type lever 240 which is known in the art.

The toggle or elbow closure of lever 240 is formed by journal 242 (around which the lever is journalled on the rear portion or spoiler 241), a direction changing element 244 provided in the wall of the spoiler 241, and the point of attachment 245 of cable 22. Means may be provided for adjusting the point of attachment of the cable to the lever, and in this embodiment, the cable 22 extends from the zone of journal 246 of the rear spoiler to direction changing element 244, and then inside the wall of the rear spoiler so that it remains protected from all exposure to external hazards.

It should be noted that preferably each of the embodiments of the present invention use extensions for the front portion of the upper that extend rearwardly between a plane parallel to and passing through the sole of the boot and a line extending through the journal of the front portion of the upper on the shell base at an approximately 45 degree angle to a horizontal plane.

Figure 17:
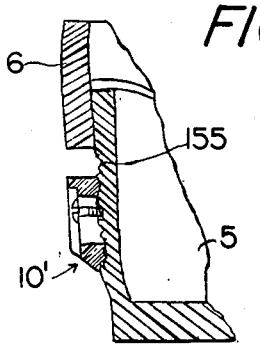
FIG. 17 is a schematic side view of means for adjusting the height of an abutment detachable from the shell base.

In addition, although each of the embodiment discussed above used an abutment that is integral with the shell base, it is within the scope of the present invention to attach an assembly to the shell base which attaches the abutment to the shell base. For example, FIG. 17 shows such an assembly. In FIG. 17 the abutment comprises assembly 10'. Abutment 10' is attached to shell base 5 by a pin and by the engagement of teeth 155 on abutment 10' with complementary shaped teeth on the rear heel portion of the shell base 5. Further, the vertical position of abutment 10' can be adjusted vertically by moving abutment 10' upwardly or downwardly with respect to the heel of shell base 5 so that teeth 155 on abutment 10' engage a different portion of teeth on shell base 5. Thus, FIG. 17 also shows means for adjusting the vertical position of the abutment means of the heel portion of the shell base.

Finally, other structural combinations can be used without going beyond the scope of the invention. In particular with respect to the journal on which the rear portion is journalled on the front portion, the journals illustrated in FIGS. 1–16 can be replaced by hinges of the plastic hinge type having a zone which is adapted to bend. These hinges have not been shown because they belong to a different technological domain.

Although the invention has been described with reference to particular means, methods, and embodiment, it should be understood that the invention is not limited to the particulars disclosed, but extends to all equivalents within the scope of the claims.

What is claimed is:

1. A ski boot comprising:

(a) shell base comprising an abutment; and (b) an upper mounted on said shell base and adapted to hold the lower leg of a skier, wherein a part of said upper engages said abutment at least in response to rearward pressure from the lower leg of the skier on said upper, wherein said upper further comprises a front portion and a rear portion, wherein said shell base further comprises a heel portion and two lateral sides, wherein said front portion of said upper comprises two lateral extensions, each extending rearwardly along a different lateral side of said shell base to said heel portion of said shell base, wherein said upper further comprises an element attached to said extensions, wherein at least one member of the following group engages said abutment at least in response to rearward pressure from the lower leg of the skier on said upper: said extensions and said element.

2. The boot defined by claim 1 wherein said abutment comprises a horizontal and a vertical surface, wherein said engaging part of said upper comprises a complementary shaped horizontal and vertical surface adapted to engage said abutment.

3. The boot defined by claim 1 wherein said element comprises a first journal around which said rear portion of said upper pivots on said front portion of said upper.

4. The bood defined by claim 3 wherein said first journal connects said extensions to each other so that said first journal comprises means for linking said extensions.

5. The boot defined by claim 3 wherein said first journal extends generally tangentially to said heel portion of said shell base.

6. The boot defined by claim 5 wherein said first journal extends generally transversely to the longitudinal axis of said boot.

7. The boot defined by claim 5 wherein said extensions each comprise a rear end portion, wherein said rear end portions of said extensions are integrally connected to each other.

8. The boot defined by claim 7 wherein said first journal comprises said integral connection between said rear end portions of said extensions.

9. The boot defined by claim 7 wherein said front portion of said upper comprises a transversely extending linkage element integrally linking said two rear end portions of said two extensions.

10. The boot defined by claim 7 further comprising means for closing said rear portion of said upper on said front portion of said upper, wherein said closing means connects said front and rear portions of said upper.

11. The boot defined by claim 7 further comprising a second journal on which said upper is at least partially journalled on said shell base, wherein said extensions extend from said second journal to said heel portion of said shell base.

12. The boot defined by claim 11 wherein said front portion of said upper is adapted for forward flexion around said second journal, wherein said boot further comprises means for controlling said forward flexion of said front portion of said upper.

13. The boot defined by claim 11 wherein said front extensions comprise a lateral portion extending from said second journal to said heel portion of said shell base, wherein said front portion of said boot is adapted to flex forwardly to a forward position from a rest position and to flex rearwardly from said forward position to said rest position, wherein said boot further comprises means for engaging said abutment with said lateral portions of said extensions in response to flexion of said front portion of said upper.

14. The boot defined by claim 11 wherein said shell base comprises two lateral sides, wherein said abutment extends along at least a portion of said two lateral sides from said second journal to said heel portion of said shell base and around said heel portion of said shell base, wherein said abutment is adapted to engage said extensions from said second journal to said heel portion of said shell base.

15. The boot defined by claim 14 wherein one of the members of the following group comprises at least one lip:

said front portion of said upper; and said rear portion of said upper, wherein said abutment extends around said heel portion of said shell base, wherein said abutment at said heel portion of said shell base comprises at least one groove for engaging said lip.

16. The boot defined by claim 11 wherein said abutment is positioned at said heel portion of said shell base directly beneath said first journal.

17. The boot defined by claim 16 wherein said abutment extends transversely to the longitudinal axis of said shell base and generally tangentially to said heel portion of said shell base.

18. The boot defined by claim 17 wherein said abutment extends from said heel portion of said shell base at least partially toward said first journal.

19. The boot defined by claim 11 wherein said heel portion of said shell base comprises a wall, and wherein said abutment comprises a shoulder having a thickness greater than said wall of said heel portion of said shell base.

20. The boot defined by claim 19 wherein said abutment forms an integral portion of said shell base.

21. The boot defined by claim 19 further comprising an assembly connecting said abutment to said shell base, wherein said abutment is integral with said shell base via said assembly.

22. The boot defined by claim 11 wherein said abutment extends only between said rear end portions of said extensions.

23. The boot defined by claim 11 wherein said front portion of said upper comprises a bridge connecting said rear end portions of said extensions, wherein said abutment is positioned directly under said bridge and extends to said second journal, wherein said bridge is adapted to engage said abutment directly under said bridge, wherein said first journal extends between said rear end portions of said extensions above said bridge.

24. The boot defined by claim 23 wherein said boot has at least one opening therein, wherein said boot further comprises means for holding the skier's foot down in said boot comprising:

(i) a lever journalled on said rear portion; and (ii) a cable attached to said lever and extending through said opening to extend inside said boot over said foot, and wherein said lever comprises means for tightening and loosening said cable, thereby adjusting the force with which said foot is held down in said boot.

25. The boot defined by claim 11 wherein said rear portion of said upper comprises a journal housing having an opening therein adapted to receive said first journal therethrough, wherein said rear end portions of said extensions each comprise an opening therein adapted to receive said first journal therethrough, wherein said journal housing is adapted to be positioned between said rear end portions of said extensions so that said opening is said journal housing is aligned with said openings in said rear end portions of said extensions.

26. The boot defined by claim 25 wherein said openings in said rear portions of said extensions are positioned directly above said heel portion of said sheel base, wherein said abutment is positioned directly under said journal housing, wherein said shell base has an opening therein for receiving said journal housing therein during rearward flexion of said rear portion of said upper, wherein said shell base further comprises a lip on said heel portion of said shell base and adjacent said journal housing, wherein said lip extends substantially concentrically to said first journal.

27. The boot defined by claim 11 wherein said rear portion of said upper comprises two spaced apart bosses each attached to one of said rear end portions of said extensions, wherein said first journal is supported by and extends between said two spaced bosses, wherein said abutment extends between said two spaced apart bosses, and wherein said first journal is supported by said abutment so as to cooperate with said abutment to control pressure of the lower leg of the skier on the rest portion of said upper.

28. The boot defined by claim 27 wherein said first journal engages said abutment in response to a rearwardly directed flexional force generated by te lower leg of the skier on said rear portion of said upper.

29. The boot defined by claim 27 further comprising at least one adjustable, elastic deformable element positioned between said abutment and said first journal.

30. The boot defined by claim 29 wherein said adjustable, elastic, deformable element comprises a compression spring.

31. The boot defined by claim 29 wherein said adjustable, elastic, deformable element comprises an extension spring.

32. The boot defined by claim 31 wherein said extension spring comprises a first end and a second end, wherein said boot further comprises a third journal attached to said shell base and connecting said first end of said extension spring to said shell base, wherein said second end of said extension spring is attached to said first journal.

33. The boot defined by claim 27 wherein said first journal integrally connects said rear end portions of said extensions, wherein said boot further comprises means for controlling the support of the front and rear portions of the lower leg of the skier by said upper, wherein said upper is at least partially journalled on said shell base against the bias of said control means, wherein said abutment comprises upper and lower abutments, wherein said lower abutment supports said first journal, wherein said upper abutment is positioned above said first journal, wherein said first journal engages said upper abutment in response to frontward pressure of the lower leg on said front portion of said upper, wherein said first journal engages said lower abutment in response to rearward pressure of the lower leg of the skier on said rear portion of said upper, wherein said control means comprises said upper and lower abutments and said first journal.

34. The boot defined by claim 33 wherein said rear portion of said upper further comprises two spaced apart bosses, each attached to one rear end portion of one of said extensions, wherein said first journal is supported by said bosses, wherein said upper and lower abutments are positioned between said bosses.

35. The boot defined by claim 33 further comprising a compression spring positioned between said upper abutment and said first journal.

36. The boot defined by claim 33 wherein said shell base comprises a rear end heel zone, wherein said upper and lower abutments extend substantially transversely to the longitudinal axis of said shell base and extend approximately tangentially to said rear end heel zone, wherein said upper and lower abutments are vertically spaced from one another a distance sufficient for passage of said first journal therebetween.

37. The boot defined by claim 36 wherein said shell base comprises a wall comprising said rear end heel zone, wherein said upper and lower abutments each comprises a shoulder having a thickness greater than the thickness of said wall comprising said rear end heel zone of said shell base.

38. The boot defined by claim 37 wherein said upper and lower abutments are integral with said shell base.

39. The boot defined by claim 37 further comprising an assembly connecting said said upper and lower abutments to said shell base, wherein said upper and lower abutments are integrally connected to said shell base by said assembly.

40. The boot defined by claim 11 wherein said boot further comprises a sole, and wherein the longitudinal axis of said extensions extends rearwardly between a plane parallel to and passing through said sole and a line extending through said second journal at an approximately 45 degree angle to a horizontal plane.

41. The boot defined by claim 11 further comprising means for varying the vertical position of said abutment along said heel portion of said shell base.

42. The boot defined by claim 11 further comprising a removable wedge, wherein said wedge is removably attached to said boot between said rear end portion of said extensions and said abutment so as to define a predetermined advancement position of said upper with respect to said shell base.

43. The boot defined by claim 42 in combination with with a plurality of wedges each of a different thickness, wherein each of said plurality of wedges are adapted to be removably attached to said binding between said abutment and said rear end portion of said extensions.

44. The boot defined by claim 11 wherein one of the members of the following group has an oblong slot therein, and the other member of the following group is attached to said first journal: the front portion of said upper and the rear portion of said upper, wherein said boot further comprises a floating hinge around which said rear portion of said upper is journalled on said extensions, wherein said floating hinge comprises said first journal engaging said oblong slot.

45. The boot defined by claim 44 wherein one the members of the following group comprises a journal element having said oblong slot therein: said front portion of said upper and said rear portion of said upper, wherein said abutment comprises a horizontal and a vertical surface, wherein said journal element engages said horizontal surface in response to downward vertical forces acting on said upper, wherein said journal element engages said vertical surface in response to rearward pressure from the lower leg of the skier on the rear portion of said upper.

46. The boot defined by claim 45 wherein said vertical surface comprises means for preventing said rear portion of said upper from rearward pivoting to an open position in which the foot of the skier can be placed in or removed from said boot until said journal element is raised above said vertical surface.

47. The boot defined by claim 46 further comprising means for pivoting said rear portion of said upper with said front portion of said upper during forward flexion of said front portion of said upper.

* * * * *